US010154738B2

(12) United States Patent
Mountz

(10) Patent No.: US 10,154,738 B2
(45) Date of Patent: Dec. 18, 2018

(54) INFANT CARRIER AND MOTION DEVICE THEREWITH

(71) Applicant: Wonderland Switzerland AG, Steinhausen (CH)

(72) Inventor: Jonathan K. Mountz, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 15/630,946

(22) Filed: Jun. 22, 2017

(65) Prior Publication Data

US 2018/0008059 A1 Jan. 11, 2018

Related U.S. Application Data

(60) Provisional application No. 62/359,802, filed on Jul. 8, 2016.

(51) Int. Cl.

| | |
|---|---|
| ***A47D 1/08*** | (2006.01) |
| ***A47D 13/10*** | (2006.01) |
| ***A47D 13/02*** | (2006.01) |

(52) U.S. Cl.

CPC ..... *A47D 13/107* (2013.01); *A47D 13/02* (2013.01); *A47D 13/105* (2013.01)

(58) Field of Classification Search

CPC ..... A47D 13/02; A47D 13/107; A47D 13/105
USPC ..... 297/274
See application file for complete search history.

(56) References Cited

U.S. PATENT DOCUMENTS

| | | | | |
|---|---|---|---|---|
| 2,988,136 | A | 6/1961 | Kowalczyk | |
| 4,998,307 | A * | 3/1991 | Cone | B60N 2/2806 297/183.2 |
| 5,092,004 | A * | 3/1992 | Cone | B60N 2/2806 297/118 |
| 6,196,629 | B1 * | 3/2001 | Onishi | B60N 2/2806 297/256.12 |
| 6,679,552 | B1 * | 1/2004 | Kassai | B60N 2/2812 297/250.1 |
| 7,407,232 | B2 * | 8/2008 | Sakamoto | A47C 7/70 297/188.01 |
| 7,475,942 | B2 * | 1/2009 | Boyle | A47D 13/105 297/273 |
| 7,845,728 | B2 * | 12/2010 | Chen | A47D 13/10 297/274 X |

(Continued)

FOREIGN PATENT DOCUMENTS

| | | |
|---|---|---|
| CN | 103315568 A | 9/2013 |
| CN | 102727002 B | 5/2015 |

(Continued)

*Primary Examiner* — Rodney B White
(74) *Attorney, Agent, or Firm* — Winston Hsu

(57) ABSTRACT

An infant carrier includes a main frame, at least one first support, at least one second support, a seatback and a seat pan pivoted to one another, so as to form a linkage mechanism. The seatback, the seat pan, the main frame, and the at least one second support are inclined to one another when the infant carrier is in a first mode. A longitudinal direction of the seat body and a longitudinal direction of the main frame are substantially parallel to each other when the infant carrier is in a second mode. Therefore, it allows an infant to sit in or lie on the infant carrier comfortably depending on the actual situation.

15 Claims, 6 Drawing Sheets

(56) References Cited

U.S. PATENT DOCUMENTS

| | | | | |
|---|---|---|---|---|
| 7,958,579 | B2 * | 6/2011 | Westerkamp | A47D 9/02 5/105 |
| 8,636,601 | B2 * | 1/2014 | Zhang | A47D 13/105 472/119 |
| 8,746,794 | B2 | 6/2014 | Oren | |
| 8,834,282 | B2 * | 9/2014 | Sclare | A47D 13/105 472/119 |
| 8,845,028 | B2 * | 9/2014 | Miller | A47D 1/002 297/274 X |
| 9,033,415 | B2 * | 5/2015 | Hopke | A47D 9/02 297/260.2 |
| 9,433,303 | B2 * | 9/2016 | Zhong | A47D 13/10 |
| 9,433,304 | B2 * | 9/2016 | Mountz | A47D 13/105 |
| 9,629,476 | B1 * | 4/2017 | Robbins | A47D 9/02 |
| 9,743,779 | B2 * | 8/2017 | Zhao | A47D 13/105 |
| 9,968,204 | B2 * | 5/2018 | Mountz | A47D 9/04 |
| 2002/0002741 | A1 | 1/2002 | Tomas | |
| 2008/0098521 | A1 | 5/2008 | Westerkamp | |
| 2010/0052387 | A1 * | 3/2010 | Hopke | A47D 9/02 297/260.2 |
| 2013/0119736 | A1 * | 5/2013 | Miller | A47D 1/002 297/354.12 |
| 2015/0082539 | A1 | 3/2015 | Lin | |
| 2015/0289677 | A1 * | 10/2015 | Huntsberger | A47D 1/08 297/260.2 X |

FOREIGN PATENT DOCUMENTS

| | | | |
|---|---|---|---|
| DE | 20 2011 051 907 | U1 | 1/2012 |
| EP | 1795424 | A2 | 6/2007 |

* cited by examiner

INFANT CARRIER AND MOTION DEVICE THEREWITH

CROSS REFERENCE TO RELATED APPLICATIONS

This application claims the benefit of U.S. Provisional Patent Application No. 62/359,802 filed on Jul. 8, 2016, which is hereby incorporated by reference in its entirety.

BACKGROUND OF THE INVENTION

1. Field of the Invention

The present invention relates to an infant carrier and a related motion device, and more particularly, to an infant carrier, which is switchable between a first mode and a second mode, and a motion device therewith.

2. Description of the Prior Art

With advance of technology, there are more and more different infant carriers available in the market. For example, a bassinet with a sleeping area surrounded by a vertical wall allows an infant to sleep safely and comfortably, and a rocker with an adjustable recline seat allows an infant to sit at different angles. However, in order to meet different demands, caregivers have to prepare different types of infant carriers in their homes. Therefore, it causes a waste of money and storage space.

SUMMARY OF THE INVENTION

Therefore, an objective of the present invention is to provide an infant carrier, which can be switched between a first mode and a second mode, and a motion device therewith for solving the aforementioned problems.

In order to achieve the aforementioned objective, the present invention discloses an infant carrier including a main frame, at least one first support, and a seat body. The at least one first support is pivoted to the main frame. The seat body includes a seatback and a seat pan. The seatback is rotatably connected to the main frame and pivoted to the at least one first support. The seat pan is pivoted to the seatback. The seatback, the seat pan, and the main frame are inclined to one another when the infant carrier is in a first mode. A longitudinal direction of the seat body and a longitudinal direction of the main frame are substantially parallel to each other when the infant carrier is in a second mode.

According to an embodiment of the present invention, the infant carrier further includes at least one seatback link including a first end and a second end opposite to the first end. The first end of the at least one seatback link is pivoted to the seatback, and the second end of the at least one seatback link is pivoted to the main frame.

According to an embodiment of the present invention, the infant carrier further includes at least one second support connected to the at least first support and pivoted to the seat pan. The seatback, the at least one seatback link, the main frame, the at least one first support, the at least one second support, and the seat pan form a linkage mechanism.

According to an embodiment of the present invention, the first end of the at least one seatback link is pivoted to the seatback at a first pivoting point. The second end of the at least one seatback link is pivoted to the main frame at a second pivoting point. An upper end of the at least one first support is pivoted to the main frame at a third pivoting point.

A lower portion of the at least one first support is pivoted to the seatback at a fourth pivoting point. The seatback is pivoted to the seat pan at a fifth pivoting point. The seat pan is pivoted to the at least one second support at a sixth pivoting point.

According to an embodiment of the present invention, the infant carrier includes two first supports, two second supports and two seatback links. The two first supports, the two second supports and the two seatback links are located at two opposite sides of the seat body symmetrically.

According to an embodiment of the present invention, the at least one second support is formed in a curved shape or a planar shape.

According to an embodiment of the present invention, the infant carrier further includes at least one recline mechanism disposed between the at least one first support and the main frame and for allowing the main frame to pivot relative to the at least one first support or restraining the main frame from pivoting relative to the at least one first support.

According to an embodiment of the present invention, when the main frame pivots relative to the at least one first support in a first pivoting direction, the main frame drives the seatback to pivot in the first pivoting direction, so as to drive the seat pan to pivot in a second pivoting direction opposite to the first pivoting direction, and when the main frame pivots relative to the at least one first support in the second pivoting direction, the main frame drives the seatback to pivot in the second pivoting direction, so as to drive the seat pan to pivot in the first pivoting direction.

According to an embodiment of the present invention, the infant carrier further includes a cloth covering the main frame, the seatback, and the seat pan, so as to form an accommodating space.

In order to achieve the aforementioned objective, the present invention further discloses a motion device including an infant carrier and a motion assembly. The infant carrier includes a main frame, at least one first support, a seat body, and a mounting pod. The at least one first support is pivoted to the main frame. The seat body includes a seatback and a seat pan. The seatback is rotatably connected to the main frame and pivoted to the at least one first support. The seat pan is pivoted to the seatback. The mounting pod is disposed under the seat body. The motion assembly is for moving the infant carrier and includes a supporting frame and a mounting receiver. The mounting receiver is disposed on an upper surface of the supporting frame and coupled to the mounting pod.

According to an embodiment of the present invention, the infant carrier further includes at least one seatback link including a first end and a second end opposite to the first end. The first end of the at least one seatback link is pivoted to the seatback, and the second end of the at least one seatback link is pivoted to the main frame.

According to an embodiment of the present invention, the infant carrier further includes at least one second support connected to the at least first support and pivoted to the seat pan, and the seatback, the at least one seatback link, the main frame, the at least one first support, the at least one second support, and the seat pan form a linkage mechanism.

According to an embodiment of the present invention, the first end of the at least one seatback link is pivoted to the seatback at a first pivoting point. The second end of the at least one seatback link is pivoted to the main frame at a second pivoting point. An upper end of the at least one first support is pivoted to the main frame at a third pivoting point. A lower portion of the at least one first support is pivoted to the seatback at a fourth pivoting point. The seatback is pivoted to the seat pan at a fifth pivoting point. The seat pan is pivoted to the at least one second support at a sixth pivoting point.

According to an embodiment of the present invention, the infant carrier includes two first supports, two second supports and two seatback links. The two first supports, the two second supports and the two seatback links are located at two opposite sides of the seat body symmetrically.

According to an embodiment of the present invention, the at least one second support is formed in a curved shape or a planar shape.

According to an embodiment of the present invention, the infant carrier further includes at least one recline mechanism disposed between the at least one first support and the main frame and for allowing the main frame to pivot relative to the at least one first support or restraining the main frame from pivoting relative to the at least one first support.

According to an embodiment of the present invention, when the main frame pivots relative to the at least one first support in a first pivoting direction, the main frame drives the seatback to pivot in the first pivoting direction, so as to drive the seat pan to pivot in a second pivoting direction opposite to the first pivoting direction, and when the main frame pivots relative to the at least one first support in the second pivoting direction, the main frame drives the seatback to pivot in the second pivoting direction, so as to drive the seat pan to pivot in the first pivoting direction.

According to an embodiment of the present invention, the infant carrier further includes a cloth covering the main frame, the seatback, and the seat pan, so as to form an accommodating space.

According to an embodiment of the present invention, the seatback, the seat pan, and the main frame are inclined to one another when the infant carrier is in a first mode, and a longitudinal direction of the seat body and a longitudinal direction of the main frame are substantially parallel to each other when the infant carrier is in a second mode.

In summary, the present invention utilizes the seatback link, the main frame, the first support, the second support and the seat pan for forming the linkage mechanism. Therefore, it allows a user to switch the infant carrier between the first mode and the second mode by pivoting the main frame relative to the first support easily. When the infant carrier is in the first mode, the seatback and the seat pan can cooperatively form a sitting area, and the sitting angle of the infant carrier can be adjusted by pivoting the main frame relative to the first support, which allows an infant to sit therein comfortably. When the infant carrier is in the second mode, the seatback and the seat pan can form a sleeping area, which allows an infant to lie thereon comfortably. Furthermore, the infant carrier of the present invention can be mounted on the motion assembly for multi-purposes, such as moving the infant carrier. It helps caregivers to consolidate and simplify their lives.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
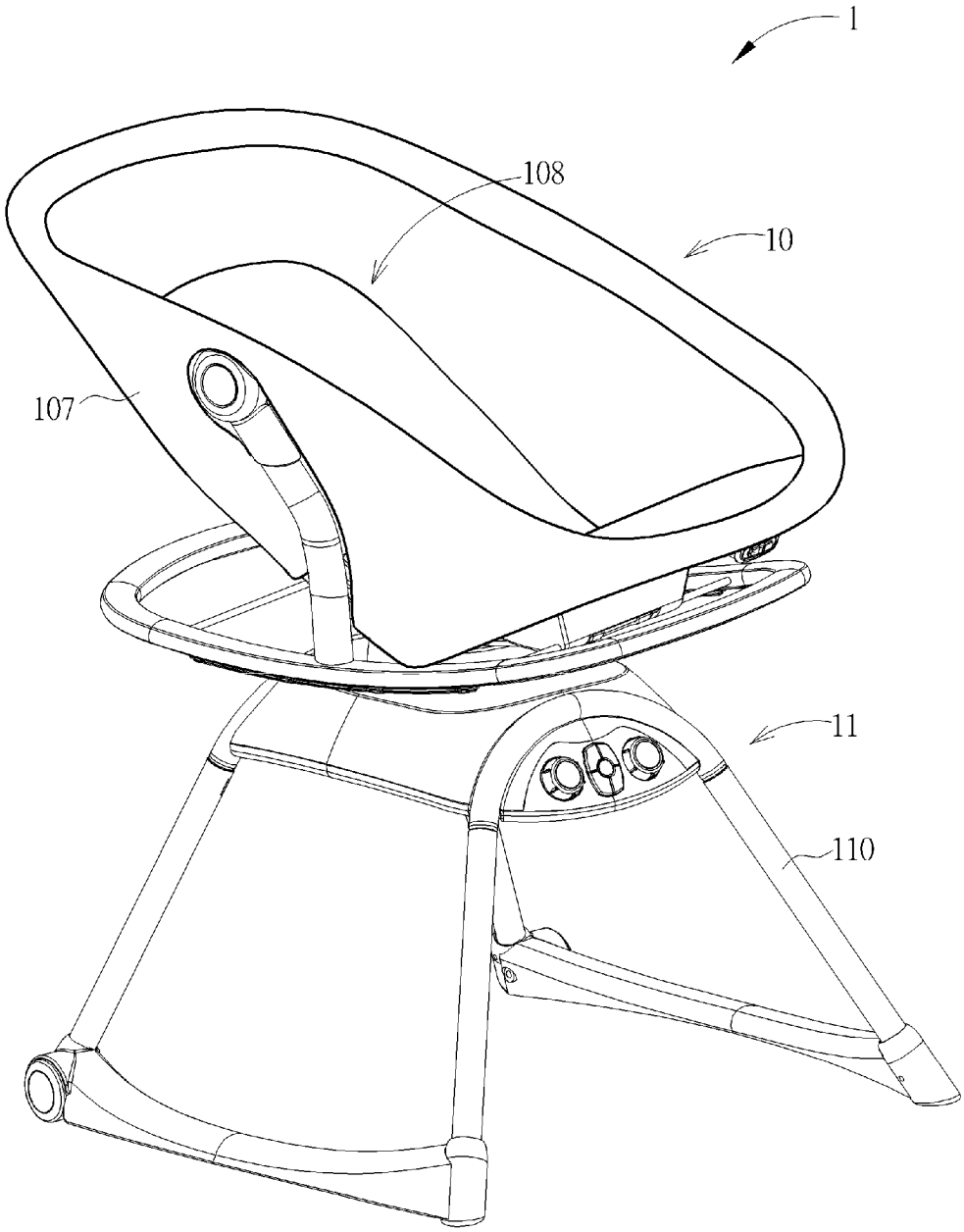
FIG. 1 and FIG. 2 are schematic diagrams of a motion device at different views according to an embodiment of the present invention.
Figure 2:
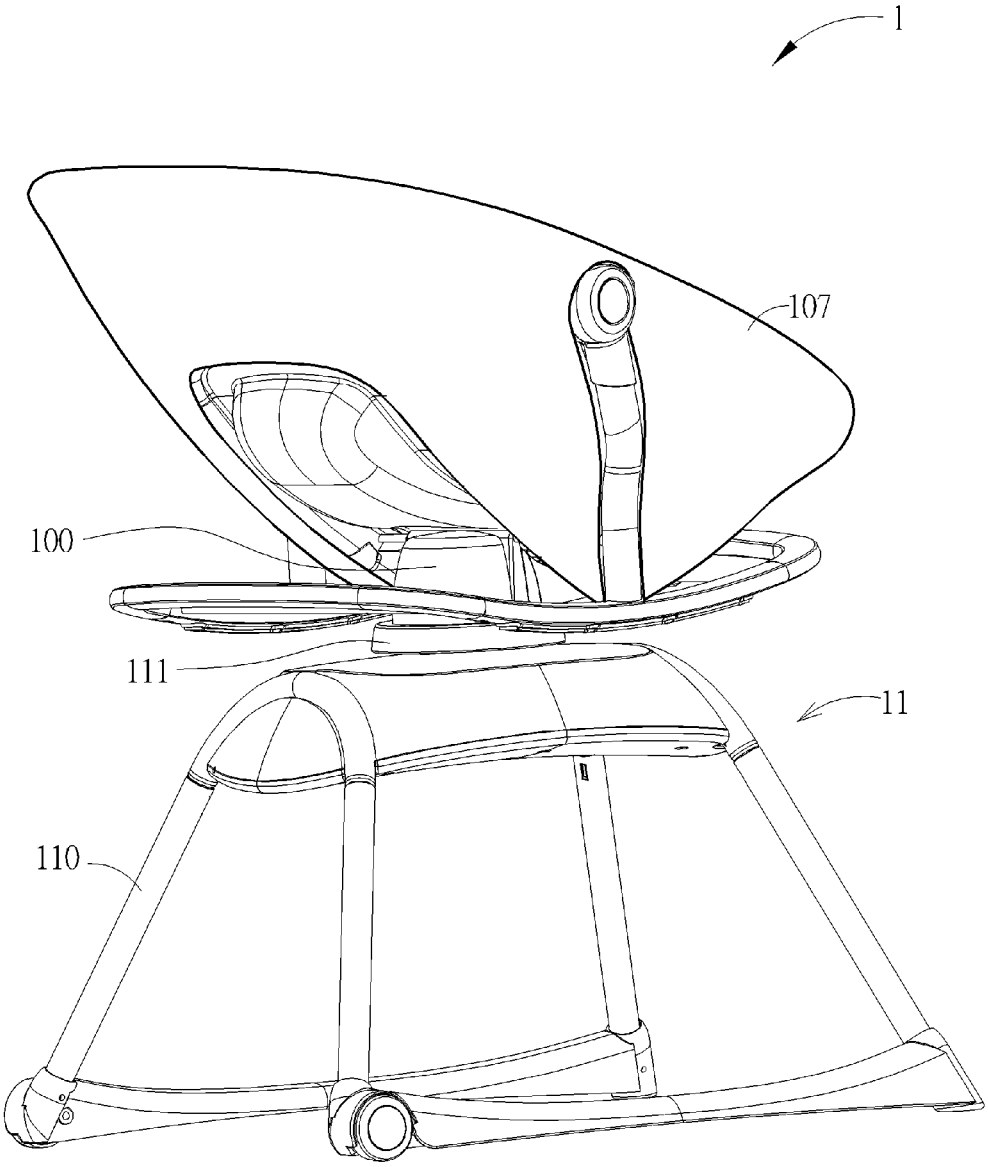

Please refer to FIG. 1 and FIG. 2. FIG. 1 and FIG. 2 are schematic diagrams of a motion device 1 at different views according to an embodiment of the present invention. The motion device 1 includes an infant carrier 10 and a motion assembly 11. The motion assembly 11 is adapted to combine with the infant carrier 10 for moving the infant carrier 10. For example, the motion assembly 11 can be a swinging assembly, a glider assembly, or a bouncer, which can provide an effect of soothing an infant in the infant carrier 10. However, it is not limited thereto. In this embodiment, the motion assembly 11 includes a supporting frame 110 and a mounting receiver 111 disposed on an upper surface of the supporting frame 110 for coupling to the infant carrier 10. However, structure of the motion assembly 11 is not limited to this embodiment. Furthermore, it is not required to mount the infant carrier 10 onto the motion assembly 11 at all times. The infant carrier 10 of the present invention also can be used independently or be mounted onto a supporting assembly.

Figure 3:
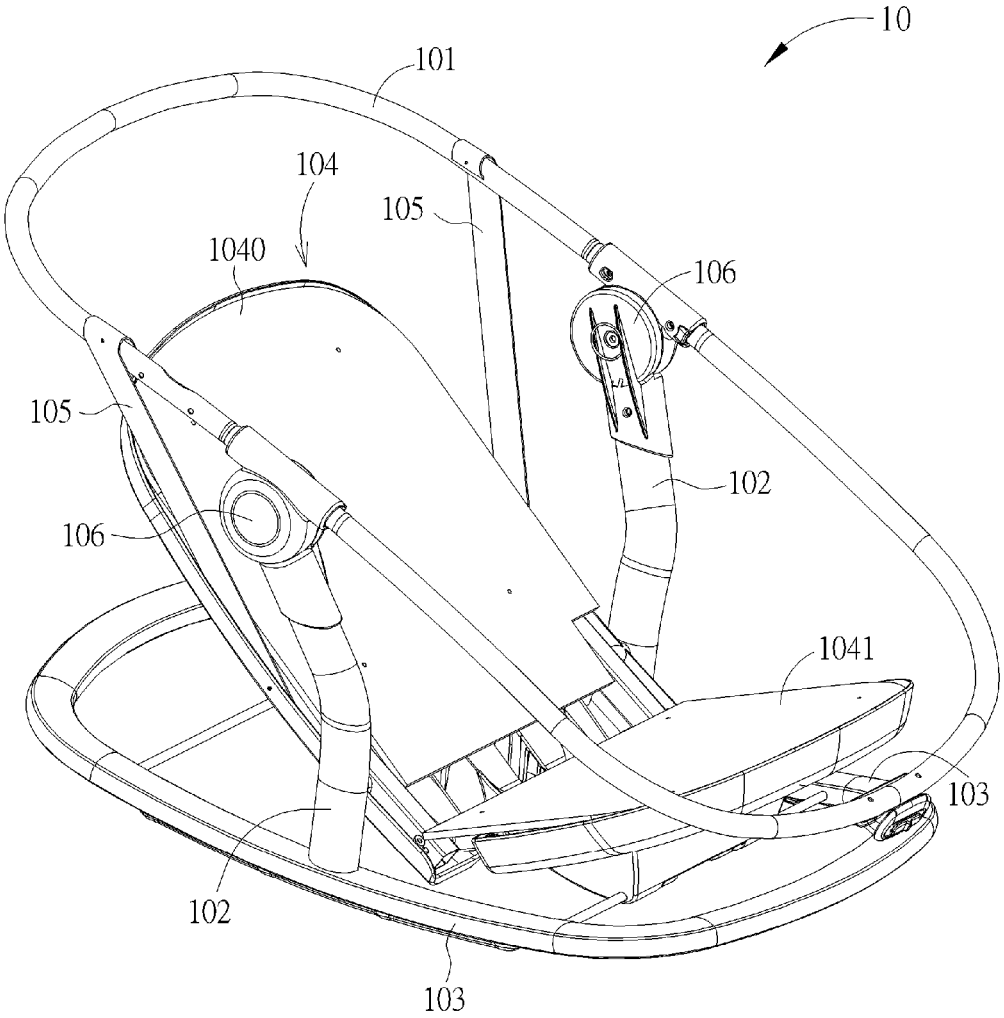
FIG. 3 and FIG. 4 are internal structural diagrams of an infant carrier at different views according to the embodiment of the present invention.
Figure 4:
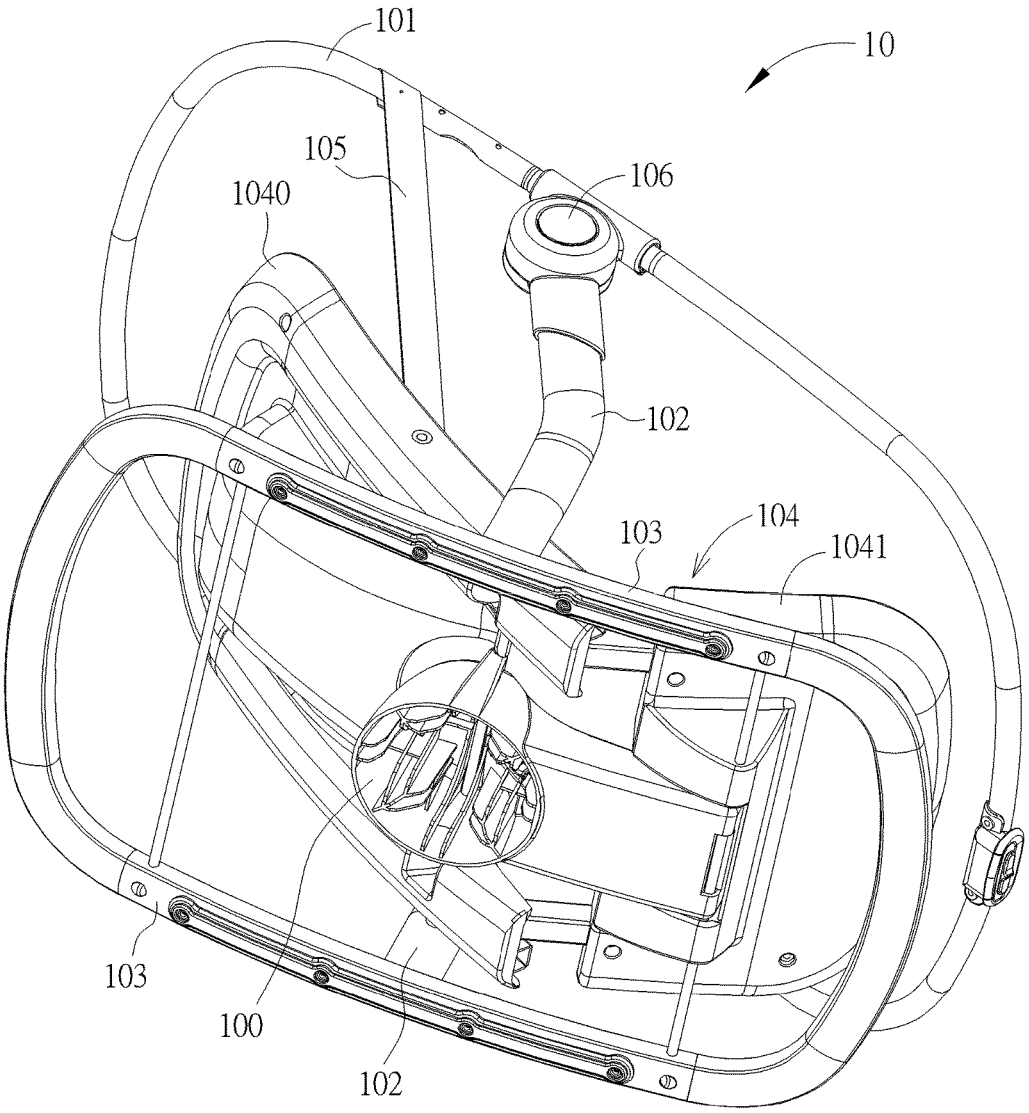

Please refer to FIG. 1 to FIG. 4. FIG. 3 and FIG. 4 are internal structural diagrams of the infant carrier 10 at different views according to the embodiment of the present invention. As shown in FIG. 1 to FIG. 4, the infant carrier 10 includes a mounting pod 100, a main frame 101, two first supports 102, two second supports 103, a seat body 104, two seatback links 105, two recline mechanisms 106, and a cloth 107. The mounting pod 100 is disposed under the seat body 104 and for coupling to the mounting receiver 111. The two first supports 102, the two second supports 103 and the two seatback links 105 are located at two opposite sides of the seat body 104 symmetrically. However, the numbers of the configurations of the first support 102, the second support 103, and the seatback link 105 are not limited to this embodiment. In another embodiment, the infant carrier 10 also can include one first support 102, one second support 103, and one seatback link 105 which are located at one side of the seat body 104.

Furthermore, in this embodiment, the main frame 101 can be formed in a ring shape. The two second supports 103 can be formed in curved shapes for rocking and connected to each other to form the ring shape corresponding to the main frame 101. Each of the two first supports 102 is pivoted to the main frame 101 by the corresponding recline mechanism 106 and rigidly connected to the corresponding second support 103. However, in another embodiment, the two second supports 103 also can be two independent planar supporting components, such as two independent supporting legs. Each of the two recline mechanisms 106 disposed between the corresponding first support 102 and the main frame 101 is for allowing the main frame 101 to pivot relative to the corresponding first support 102 or restraining the main frame 101 from pivoting relative to the corresponding first support 102. The seat body 104 is located between the main frame 101 and the two second supports 103 and includes a seatback 1040 and a seat pan 1041. The seatback 1040 is rotatably connected to the main frame 101 by the two seatback links 105 and pivoted to the two first supports 102. The seat pan 1041 is pivoted to the seatback 1040 and the two second supports 103. The cloth 107 covers the main frame 101, the seatback 1040, and the seat pan 1041, so as to form an accommodating space 108 for accommodating an infant.

Figure 5:
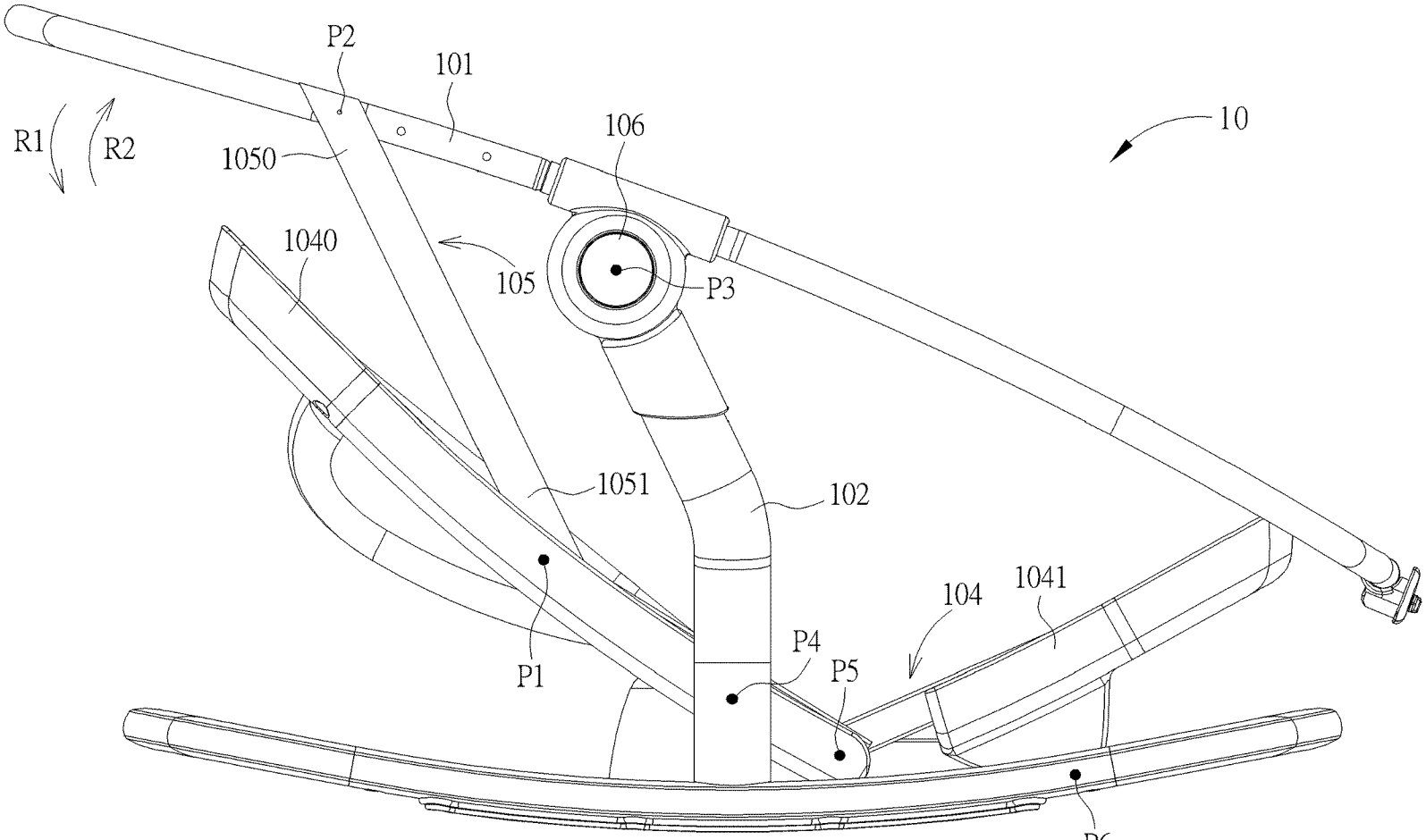
FIG. 5 and FIG. 6 are lateral diagrams of the infant carrier in different modes without illustrating a cloth according to the embodiment of the present invention.
Figure 6:
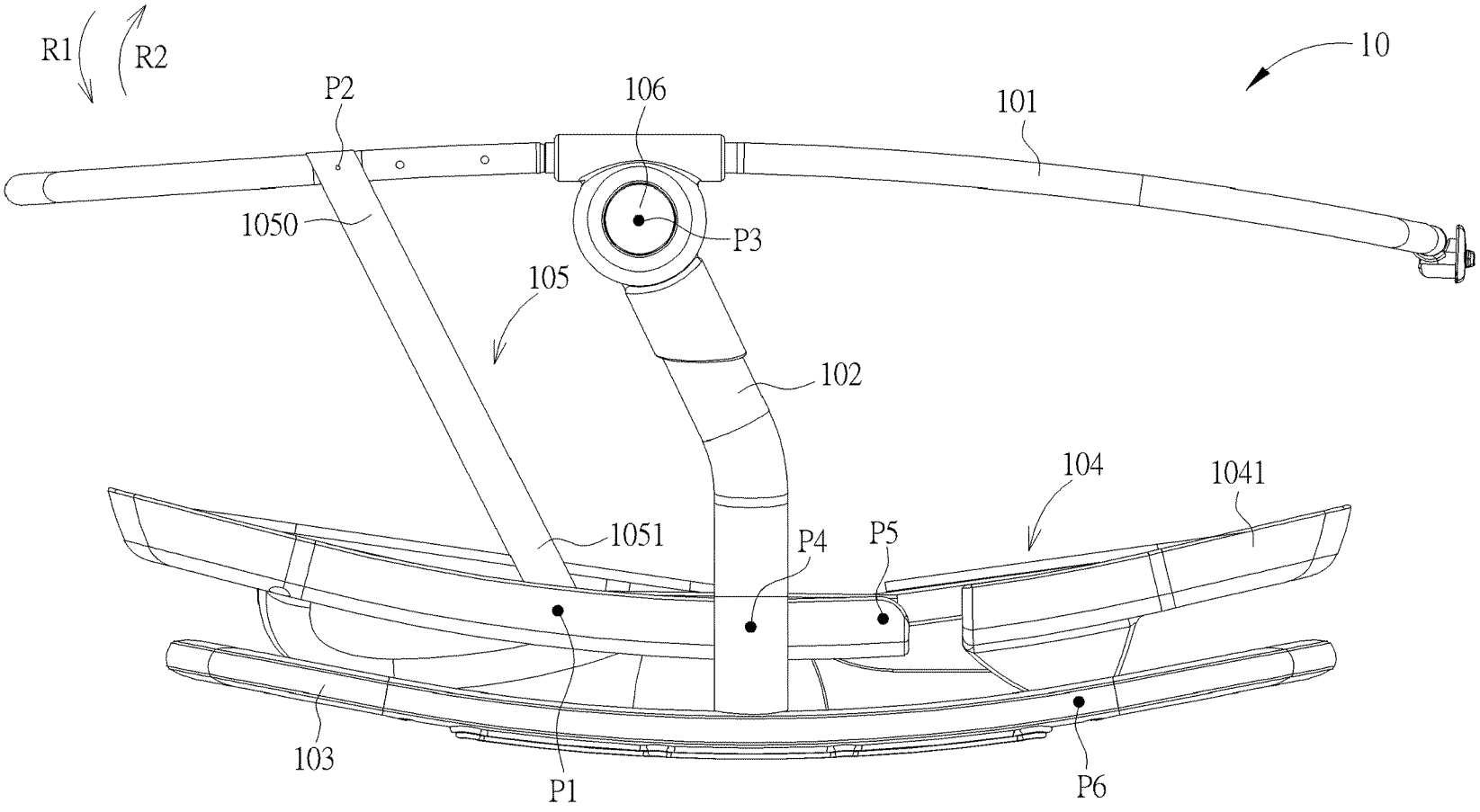

More specifically, please refer to FIG. 5 and FIG. 6. FIG. 5 and FIG. 6 are lateral diagrams of the infant carrier 10 in different modes without illustrating the cloth 107 according to the embodiment of the present invention. As shown in FIG. 5 and FIG. 6, each of the two seatback links 105 includes a first end 1050 and a second end 1051 opposite to the first end 1050. The first end 1050 is pivoted to the seatback 1040 at a first pivoting point P1. The second end 1051 is pivoted to the main frame 101 at a second pivoting point P2. An upper end of each of the two first supports 102 is pivoted to the main frame 101 at a third pivoting point P3 by the corresponding recline mechanism 106. A lower portion of each of the two first supports 102 is pivoted to the seatback 1040 at a fourth pivoting point P4. The seatback 1040 is pivoted to the seat pan 1041 at a fifth pivoting point P5. Each of the two second supports 103 is pivoted to the seat pan 1041 at a sixth pivoting point P6. Furthermore, the first pivoting point P1, the second pivoting point P2, the third pivoting point P3, the fourth pivoting point P4, the fifth pivoting point P5, and the sixth pivoting point P6 are arranged in a P shape substantially. Furthermore, in this embodiment, structures of two lateral sides of the infant carrier 10 are the same, and therefore, the pivoting points P1-P6 are symmetrically located at two opposite sides of the infant carrier 10. In such a way, the seatback 1040, the seatback link 105, the main frame 101, the first support 102, the second support 103, and the seat pan 1041 forma linkage mechanism.

The operational principle of the infant carrier 10 of the present invention is described as follows. FIG. 5 and FIG. 6 respectively illustrate that the infant carrier 10 is in a first mode and a second mode. In this embodiment, as shown in FIG. 5 and FIG. 6, the first mode can be a seat mode, and the second mode can be a bassinet mode. When it is desired to switch the infant carrier 10 from the first mode as shown in FIG. 5 to the second mode as shown in FIG. 6, the two recline mechanisms 106 can be operated to allow the main frame 101 to pivot relative to the two first supports 102 around the two third pivoting points P3 in a first pivoting direction R1. When the main frame 101 pivots relative to the two first supports 102 around the third pivoting points P3 in the first pivoting direction R1, the main frame 101 drives the two seatback links 105 via the second pivoting points P2, so as to drive the seatback 1040 via the two first pivoting points P1 to pivot relative to the two first supports 102 around the two fourth pivoting points P4 in the first pivoting direction R1. During a process that the seatback 1040 pivots relative to the two first supports 102 around the two fourth pivoting points P4 in the first pivoting direction R1, the seat pan 1041 is driven by the seatback 1040 via the two fifth pivoting points P5 to pivot relative to the two second supports 103 around the two sixth pivoting points P6 in a second pivoting direction R2 opposite to the first pivoting direction R1 until the infant carrier 10 is in the second mode as shown in FIG. 6. When the infant carrier 10 is in the second mode as shown in FIG. 6, the seat back 1040 and seat pan 1041 cooperatively form a sleeping area, and longitudinal directions of the two second supports 103, a longitudinal direction of the seat body 104, and a longitudinal direction of the main frame 101 are substantially parallel to one another. Therefore, it allows an infant to lie on the infant carrier 10 comfortably. At this time, the two recline mechanisms 106 can be operated to restrain the main frame 101 from pivoting relative to the two first supports 102, so as to fix the infant carrier 10 in the second mode.

On the other hands, when it is desired to switch the infant carrier 10 from the second mode as shown in FIG. 6 to the first mode as shown in FIG. 5, the two recline mechanisms 106 can be operated to allow the main frame 101 to pivot relative to the two first supports 102 in the second pivoting direction R2 around the two third pivoting points P3. When the main frame 101 pivots relative to the two first supports 102 around the two third pivoting points P3 in the second pivoting direction R2, the main frame 101 drives the two seatback links 105 via the two second pivoting points P2, so as to drive the seatback 1040 via the two first pivoting points P1 to pivot relative to the two first supports 102 around the two fourth pivoting points P4 in the second pivoting direction R2. During a process that the seatback 1040 pivots relative to the two first supports 102 around the two fourth pivoting points P4 in the second pivoting direction R2, the seat pan 1041 is driven by the seatback 1040 via the two fifth pivoting points P5 to pivot relative to the two second supports 103 around the sixth pivoting point P6 in the first pivoting direction R1. When the infant carrier 10 is in the first mode as shown in FIG. 5, the seatback 1040, the seat pan 1041, and the main frame 101 are inclined to one another, and the seat back 1040 and the seat pan 1041 cooperatively form a sitting area. At this time, the two recline mechanisms 106 can be operated to restrain the main frame 101 from pivoting relative to the two first supports 102, so as to fix the infant carrier 10 in the first mode. Moreover, it should be noticed that a sitting angle of the seat body 104 can be adjusted along with a reclining angle of the main frame 101 relative to the two first supports 102, and the reclining angle of the main frame 101 relative to the two first supports 102 can be adjusted by the two recline mechanisms 106 easily. Therefore, it allows an infant to sit in the infant carrier 10 comfortably.

In contrast to the prior art, the present invention utilizes the seatback link, the main frame, the first support, the second support, and the seat pan for forming the linkage mechanism. Therefore, it allows a user to switch the infant carrier between the first mode and the second mode by pivoting the main frame relative to the first support easily. When the infant carrier is in the first mode, the seatback and the seat pan can cooperatively form a sitting area, and the sitting angle of the infant carrier can be adjusted by pivoting the main frame relative to the first support, which allows an infant to sit therein comfortably. When the infant carrier is in the second mode, the seatback and the seat pan can cooperatively form the sleeping area, which allows an infant to lie thereon comfortably. Furthermore, the infant carrier of the present invention can be mounted onto the supporting assembly for multi-purposes. For example, the infant carrier can be mounted onto the motion assembly for motioning the infant carrier. It helps caregivers to consolidate and simplify their lives.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant carrier comprising:

a main frame;

at least one first support pivoted to the main frame;

a seat body comprising;

a seatback rotatably connected to the main frame and pivoted to the at least one first support; and a seat pan pivoted to the seatback;

at least one seatback link comprising a first end and a second end opposite to the first end, the first end of the at least one seatback link being pivoted to the seatback, and the second end of the at least one seatback link being pivoted to the main frame; and at least one second support connected to the at least one first support and pivoted to the seat pan, wherein the seatback, the at least one seatback link, the main frame, the at least one first support, the at least one second support and the seat pan form a linkage mechanism;

wherein the seatback, the seat pan, and the main frame are inclined to one another when the infant carrier is in a first mode, and a longitudinal direction of the seat body and a longitudinal direction of the main frame are substantially parallel to each other when the infant carrier is in a second mode.

2. The infant carrier of claim 1, wherein the first end of the at least one seatback link is pivoted to the seatback at a first pivoting point, the second end of the at least one seatback link is pivoted to the main frame at a second pivoting point, an upper end of the at least one first support is pivoted to the main frame at a third pivoting point, a lower portion of the at least one first support is pivoted to the seatback at a fourth pivoting point, the seatback is pivoted to the seat pan at a fifth pivoting point, the seat pan is pivoted to the at least one second support at a sixth pivoting point.

3. The infant carrier of claim 1, comprising two first supports, two second supports and two seatback links, wherein the two first supports, the two second supports and the two seatback links are located at two opposite sides of the seat body symmetrically.

4. The infant carrier of claim 1, wherein the at least one second support is formed in a curved shape or a planar shape.

5. The infant carrier of claim 1, further comprising at least one recline mechanism disposed between the at least one first support and the main frame and for allowing the main frame to pivot relative to the at least one first support or restraining the main frame from pivoting relative to the at least one first support.

6. The infant carrier of claim 1, wherein when the main frame pivots relative to the at least one first support in a first pivoting direction, the main frame drives the seatback to pivot in the first pivoting direction, so as to drive the seat pan to pivot in a second pivoting direction opposite to the first pivoting direction, and when the main frame pivots relative to the at least one first support in the second pivoting direction, the main frame drives the seatback to pivot in the second pivoting direction, so as to drive the seat pan to pivot in the first pivoting direction.

7. The infant carrier of claim 1, further comprising a cloth covering the main frame, the seatback, and the seat pan, so as to form an accommodating space.

8. A motion device comprising:

an infant carrier comprising:

a main frame;

at least one first support pivoted to the main frame;

a seat body comprising;

a seatback rotatably connected to the main frame and pivoted to the at least one first support; and a seat pan pivoted to the seatback;

a mounting pod disposed under the seat body;

at least one seatback link comprising a first end and a second end opposite to the first end, the first end of the at least one seatback link being pivoted to the seatback, and the second end of the at least one seatback link being pivoted to the main frame; and at least one second support connected to the at least one first support and pivoted to the seat pan, wherein the seatback, the at least one seatback link, the main frame, the at least one first support, the at least one second support and the seat pan form a linkage mechanism; and a motion assembly for moving the infant carrier, the motion assembly comprising:

a supporting frame; and a mounting receiver disposed on an upper surface of the supporting frame and coupled to the mounting pod.

9. The motion device of claim 8, wherein the first end of the at least one seatback link is pivoted to the seatback at a first pivoting point, the second end of the at least one seatback link is pivoted to the main frame at a second pivoting point, an upper end of the at least one first support is pivoted to the main frame at a third pivoting point, a lower portion of the at least one first support is pivoted to the seatback at a fourth pivoting point, the seatback is pivoted to the seat pan at a fifth pivoting point, the seat pan is pivoted to the at least one second support at a sixth pivoting point.

10. The motion device of claim 8, wherein the infant carrier comprises two first supports, two second supports and two seatback links, and the two first supports, the two second supports and the two seatback links are located at two opposite sides of the seat body symmetrically.

11. The motion device of claim 8, wherein the at least one second support is formed in a curved shape or a planar shape.

12. The motion device of claim 8, wherein the infant carrier further comprises at least one recline mechanism disposed between the at least one first support and the main frame and for allowing the main frame to pivot relative to the at least one first support or restraining the main frame from pivoting relative to the at least one first support.

13. The motion device of claim 8, wherein when the main frame pivots relative to the at least one first support in a first pivoting direction, the main frame drives the seatback to pivot in the first pivoting direction, so as to drive the seat pan to pivot in a second pivoting direction opposite to the first pivoting direction, and when the main frame pivots relative to the at least one first support in the second pivoting direction, the main frame drives the seatback to pivot in the second pivoting direction, so as to drive the seat pan to pivot in the first pivoting direction.

14. The motion device of claim 8, wherein the infant carrier further comprises a cloth covering the main frame, the seatback, and the seat pan, so as to form an accommodating space.

15. The motion device of claim 8, wherein the seatback, the seat pan, and the main frame are inclined to one another when the infant carrier is in a first mode, and a longitudinal direction of the seat body and a longitudinal direction of the main frame are substantially parallel to each other when the infant carrier is in a second mode.

* * * * *